US007222570B2

(12) United States Patent
Kawamura et al.

(10) Patent No.: US 7,222,570 B2
(45) Date of Patent: May 29, 2007

(54) PLANOGRAPHIC PRINTING PLATE SUPPLY UNIT INCLUDING CARRYING ROLLER WITH HOLLOW CONVEX PORTIONS

(75) Inventors: Yoshinori Kawamura, Kanagawa (JP); Kikuo Matsuba, Kanagawa (JP); Kazuoki Komiyama, Kanagawa (JP); Yoshihiro Koyanagi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/222,939

(22) Filed: Sep. 12, 2005

(65) Prior Publication Data

US 2006/0054042 A1 Mar. 16, 2006

(30) Foreign Application Priority Data

Sep. 14, 2004 (JP) ..... 2004-266627

(51) Int. Cl.
*B65H 3/06* (2006.01)
*B41J 13/76* (2006.01)

(52) U.S. Cl. ..... 101/477; 271/109; 271/119; 492/30; 400/629; 400/641

(58) Field of Classification Search ..... 400/624, 400/629, 641; 271/109, 119, 120; 492/28, 492/30, 33, 35, 36; 101/477
See application file for complete search history.

(56) References Cited

U.S. PATENT DOCUMENTS 5,120,042 A * 6/1992 Goto et al. ..... 271/117
6,425,578 B1 7/2002 Wood et al.
6,626,427 B2 * 9/2003 Choi et al. ..... 271/119
2003/0222394 A1 12/2003 Sano et al.

FOREIGN PATENT DOCUMENTS

| | | |
|---|---|---|
| EP | 0 347 889 | 12/1989 |
| EP | 0 539 003 | 4/1993 |
| JP | A 60-061438 | 4/1985 |
| JP | A 60-202028 | 10/1985 |
| JP | 10279114 A * | 10/1998 |
| JP | A 2003-182904 | 7/2003 |

* cited by examiner

*Primary Examiner*—Leslie J. Evanisko
(74) *Attorney, Agent, or Firm*—Margaret A. Burke; Sheldon J. Moss

(57) ABSTRACT

A planographic printing plate supply unit comprising: carrying rollers rotating while pressing a stacking bundle, in which planographic printing plates and covering papers are stacked alternately, so as to carry the planographic printing plate and covering paper at the top of the stacking bundle, wherein convex portions which are elastically deformed when pressing the stacking bundle and whose contact area with the planographic printing plate is larger after being elastically deformed than before are provided on the outside periphery of the carrying roller.

3 Claims, 9 Drawing Sheets

PLANOGRAPHIC PRINTING PLATE SUPPLY UNIT INCLUDING CARRYING ROLLER WITH HOLLOW CONVEX PORTIONS

CROSS-REFERENCE TO RELATED APPLICATION

This application claims priority under 35 USC 119 from Japanese Patent Application No. 2004-266627, the disclosure of which is incorporated by reference herein.

BACKGROUND OF THE INVENTION

1. Field of the Invention

The present invention relates to a planographic printing plate supply unit and more particularly, a planographic printing plate supply unit which supplies pairs of planographic printing plates and covering papers one by one from a stacking bundle in which the planographic printing plates and the covering papers are stacked alternately.

2. Description of the Related Art

Generally, an image recording face of a planographic printing plate is covered with a protective covering paper attached thereto and a plurality of these units are stacked in a thickness direction so as to compose a bundle of the planographic printing plates. If an image is recorded on the planographic printing plate with an exposure unit or the like, it is necessary to pick up the planographic printing plates one by one from the bundle and supply then to the exposure unit.

For example, according to an image recording material sheeting unit described in Japanese Patent Application Laid-Open (JP-A) No. 2003-182904, printing plates and covering papers are stacked alternately in a cassette of the sheet transporting portion and a sucker suctions the covering paper and planographic printing plate from above the covering paper and raises them to bring them out of the cassette. After the printing plate and covering paper are taken out, the covering paper is separated from the suctioned printing plate by means of a fan. However, because the structure uses the sucker to supply the printing plate, there are concerns that the structure may become complicated and cost may increase.

Contrary to this, JP-A No. 60-202028 has disclosed a structure in which the covering paper is fed out by a roller and the planographic printing plate is sent out by a vacuum pad. However, according to this configuration, because the planographic printing plates or the covering papers are taken out one by one, a next planographic printing plate cannot be taken out until the covering paper is taken out, thereby taking much time. Further, because the planographic printing plate and the covering paper each need a taking-out mechanism, the quantity of components increases thereby possibly inducing increases in size of the unit and manufacturing costs.

Although conveying a planographic printing plate and a covering paper with a roller as a pair is conceivable, often only a planographic printing plate is carried separately from the covering paper or two pairs of the planographic printing plate and the covering paper are carried simultaneously due to penetration of air into gaps between the planographic printing plates.

SUMMARY OF THE INVENTION

In views of the above-described problems, an object of the present invention is to provide a planographic printing plate supply unit capable of reliably removing a single pair of a planographic printing plate and a covering paper from a stacking bundle of the planographic printing plates and covering papers, and having a simple structure.

To achieve the above object, according to a first aspect of the invention, a planographic printing plate supply unit comprises: carrying rollers rotating while pressing a stacking bundle in which planographic printing plates and covering papers are stacked alternately so as to carry a planographic printing plate and covering paper at the top of the stacking bundle, wherein convex portions which are elastically deformed when pressing the stacking bundle and whose contact area with the planographic printing plate is larger after being elastically deformed than before are provided on the outside periphery of the carrying roller.

In the planographic printing plate supply unit having the above-mentioned structure, its carrying rollers rotate while pressing the stacking bundle so as to carry the planographic printing plate and covering paper. As a consequence, a supplying time of the planographic printing plate can be reduced.

If a difference occurs between water content in the air and the water content in the covering paper, wrinkles are generated in the covering paper and due to the wrinkles, air enters between the stacked planographic printing plates thereby reducing friction between the covering paper and the planographic printing plate. As a consequence, the planographic printing plate located uppermost is conveyed away from above a gap into which much air enters. As a result, two pairs of the planographic printing plate and the covering paper are carried away or only a single planographic printing plate is carried separately from the covering paper, so that a planographic printing plate and covering paper cannot be carried in single pairs.

If the pressing force for eliminating the wrinkles in the covering paper is increased, the front end of the planographic printing plate is distorted so that air invades between the planographic printing plates from the front end portion and the same result as described above occurs.

According to the invention, the outside periphery of the carrying roller is provided with convex portions which are elastically deformable. The convex portion is elastically deformed when the carrying rollers press the planographic printing plate, so that the contact area with the planographic printing plate becomes larger than it was before being elastically deformed. Thus, the carrying rollers make contact with the planographic printing plate over a large area. Due to the contact, air existing between the planographic printing plate and the covering paper throughout the large contact area can be released thereby making it possible to prevent feeding of only a planographic printing plate separately or two pairs of the planographic printing plate and the covering paper at the same time.

Further, because the load on the planographic printing plate is dispersed as the contact area between the carrying roller and the planographic printing plate is large, the distortion of the planographic printing plate can be minimized and the flow-in of air can be blocked.

In the first aspect, the convex portions are permitted to have a hollow portion.

By forming the hollow portion in the convex portion, even if material which is difficult to deform due to high hardness and excellent durability is used, it can be deformed easily so as to secure a large contact area.

Further, the convex portions may be provided along at least one of the axial direction or the circumferential direction of the carrying roller at a predetermined interval.

If the convex portion is disposed in such a way, space is formed between the convex portions, so that individual convex portions become easy to elastically deform.

According to a second aspect of the invention, a planographic printing plate supply unit comprises: a carrying roller rotating while pressing a stacking bundle in which planographic printing plates and covering papers are stacked alternately so as to carry a planographic printing plate and covering paper at the top of the stacking bundle, wherein an outside peripheral portion of the carrying roller is composed of a rubber layer and the hardness of the rubber layer is from 20 degrees to 40 degrees.

Generally, the hardness of rubber used as the carrying roller is about 50 degrees. Under this hardness, deformation of a contact portion with the planographic printing plate is small, so that carrying of only a planographic printing plate separately or two pairs of the planographic printing plate and the covering paper simultaneously occurs due to flow-in of air like the above-described case.

According to the above-described structure, the hardness of rubber constituting the rubber layer is set to from 20 degrees to 40 degrees. In this range, the contact area with the planographic printing plate can be made large due to the deformation of the rubber and air existing between the planographic printing plate and covering paper can be released throughout the large contact area, thereby making it possible to prevent carrying of only a planographic printing plate separately or two pairs of the planographic printing plate and the covering paper simultaneously.

According to the second aspect, the carrying roller may be disposed at a position in which an elastically deformed portion thereof formed when the carrying roller presses the planographic printing plate contacts with a corner of the planographic printing plate.

The flow of air into the gap between the planographic printing plate and the covering paper is likely to occur from the front end in the carrying direction. Thus, as described above, the carrying rollers are disposed at the position in which the corner of the planographic printing plate contacts with the portion elastically deformed by the pressing force. As a consequence, air at the contact portion can be released and the flow-in of air from the front end in the carrying direction can be avoided thereby making it possible to prevent the carrying of only a planographic printing plate separately or two pairs of the planographic printing plate and the covering paper simultaneously.

According to a third aspect of the invention, a planographic printing plate supply unit comprises: a carrying roller rotating while pressing a stacking bundle in which planographic printing plates and covering papers are stacked alternately so as to carry a planographic printing plate and covering paper at the top of the stacking bundle, wherein an outside peripheral portion of the carrying roller is composed of an adhesive layer which adheres to the planographic printing plate.

In the above-mentioned planographic printing plate supply unit, the carrying rollers rotate while pressing the stacking bundle so as to carry the planographic printing plate and the covering paper. Thus, the supplying time of the planographic printing plates can be reduced. Because the adhesive layer formed on the outside periphery of the carrying roller adheres to the planographic printing plate, the planographic printing plate can be carried with a small load. Therefore, the pressing force does not need to be increased for the carrying, and in this case, it is possible to avoid the flow-in of air due to distortion of the planographic printing plate end portion which may occur when the pressing force is increased, thereby making it possible to prevent the carrying of only a single planographic printing plate separately or two pairs of the planographic printing plate and the covering paper simultaneously.

According to a fourth aspect of the invention, a planographic printing plate supply unit comprises: a carrying roller rotating while pressing a stacking bundle in which planographic printing plates and covering papers are stacked alternately so as to carry a planographic printing plate and covering paper at the top of the stacking bundle, wherein an outside peripheral portion of the carrying roller is elastically deformed when pressing so that a contact area thereof with the planographic printing plate is larger after being elastically deformed than before.

DETAILED DESCRIPTION OF THE INVENTION

FIRST EMBODIMENT

Figure 1:
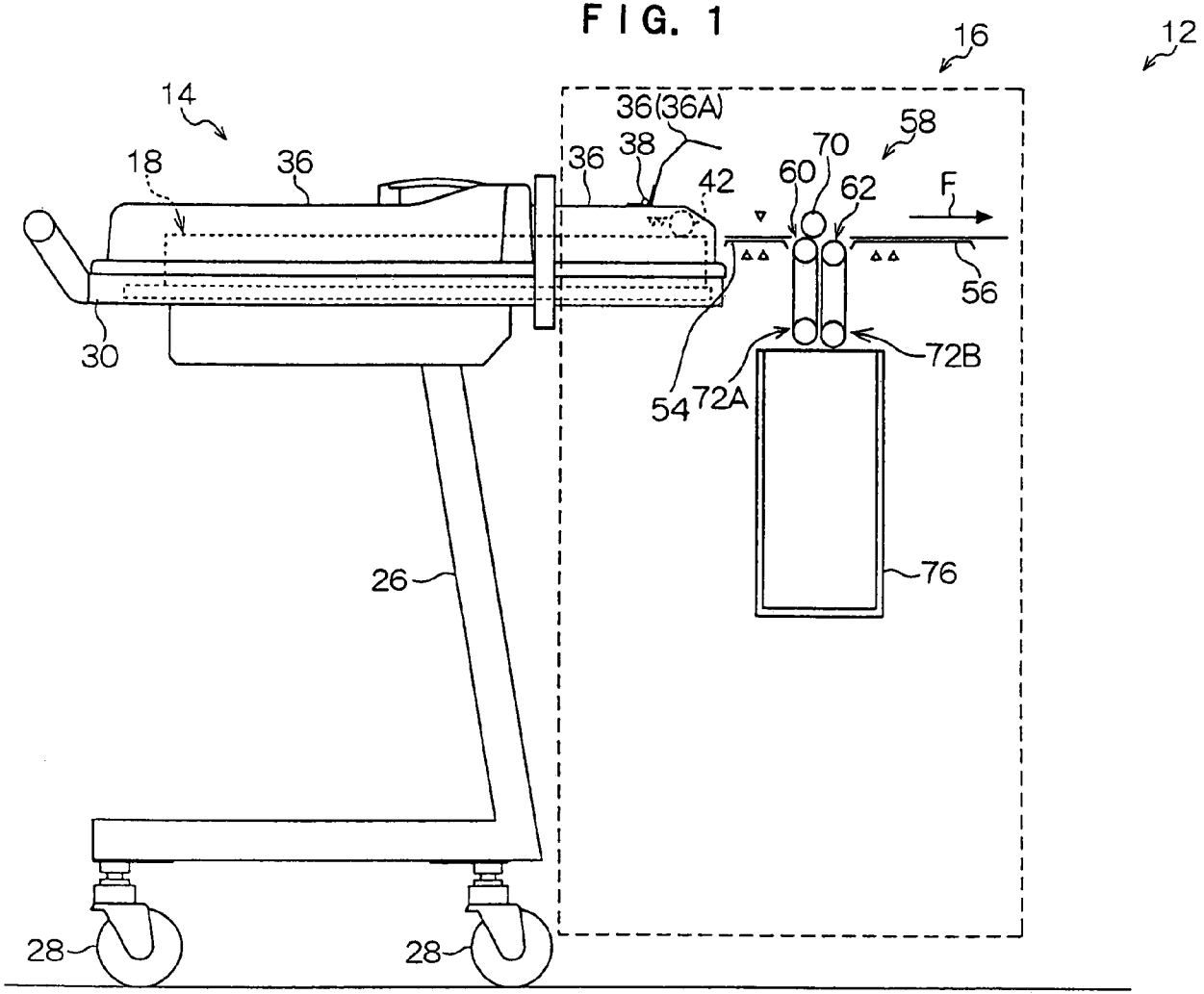
FIG. 1 is a side view showing a planographic printing plate supply unit according to a first embodiment of the present invention.
Figure 2:
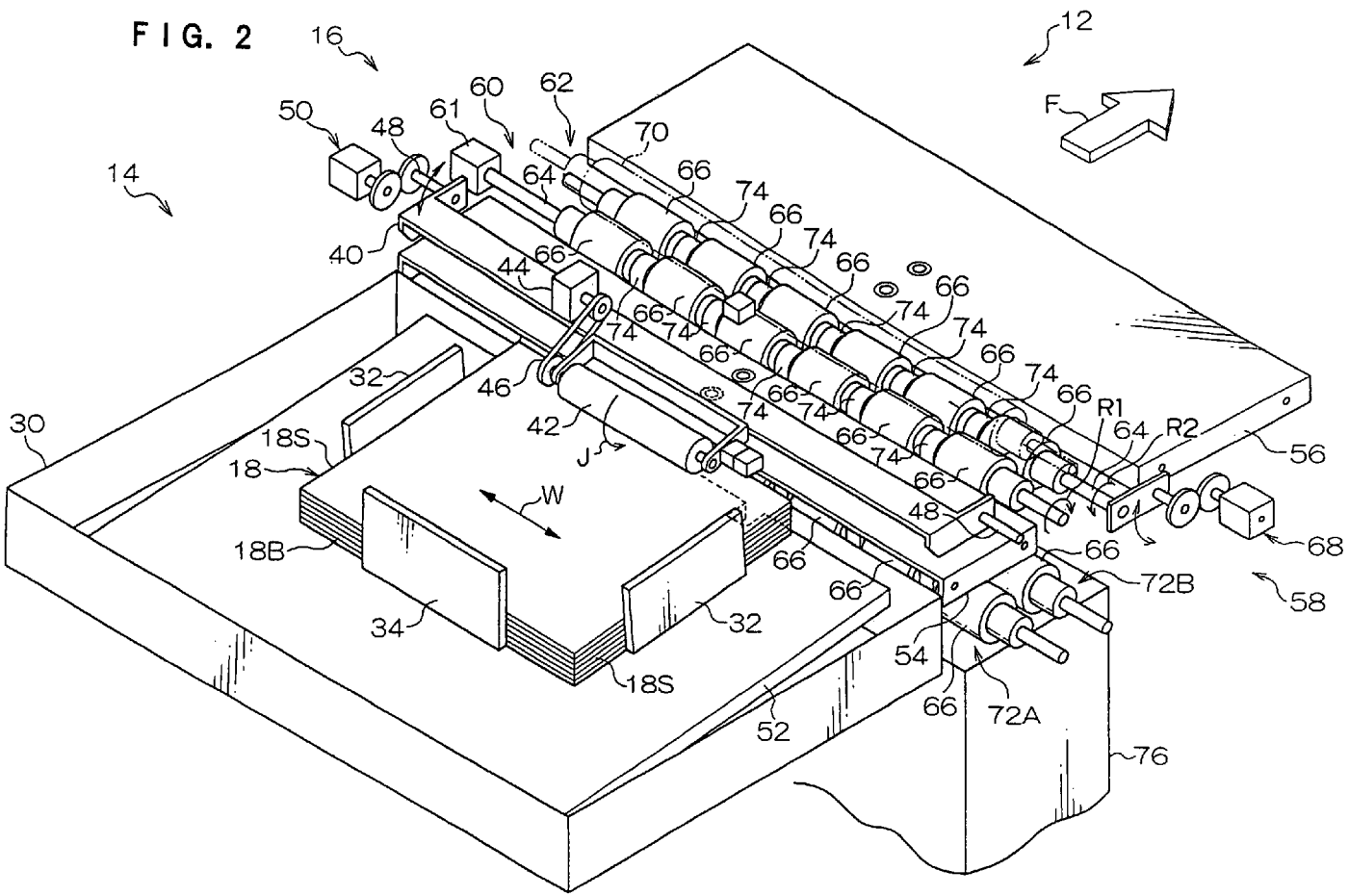
FIG. 2 is a perspective view showing a loading unit and a carrying unit of the planographic printing plate supply unit of FIG. 1.

FIG. 1 shows the entire structure of a planographic printing plate supply unit 12 according to the first embodiment of the present invention. FIG. 2 shows a loading portion 14 and a carrying portion 16 of the planographic printing plate supply unit 12 in a condition in which a bundle 18 is mounted on the loading portion 14.

Figure 3:
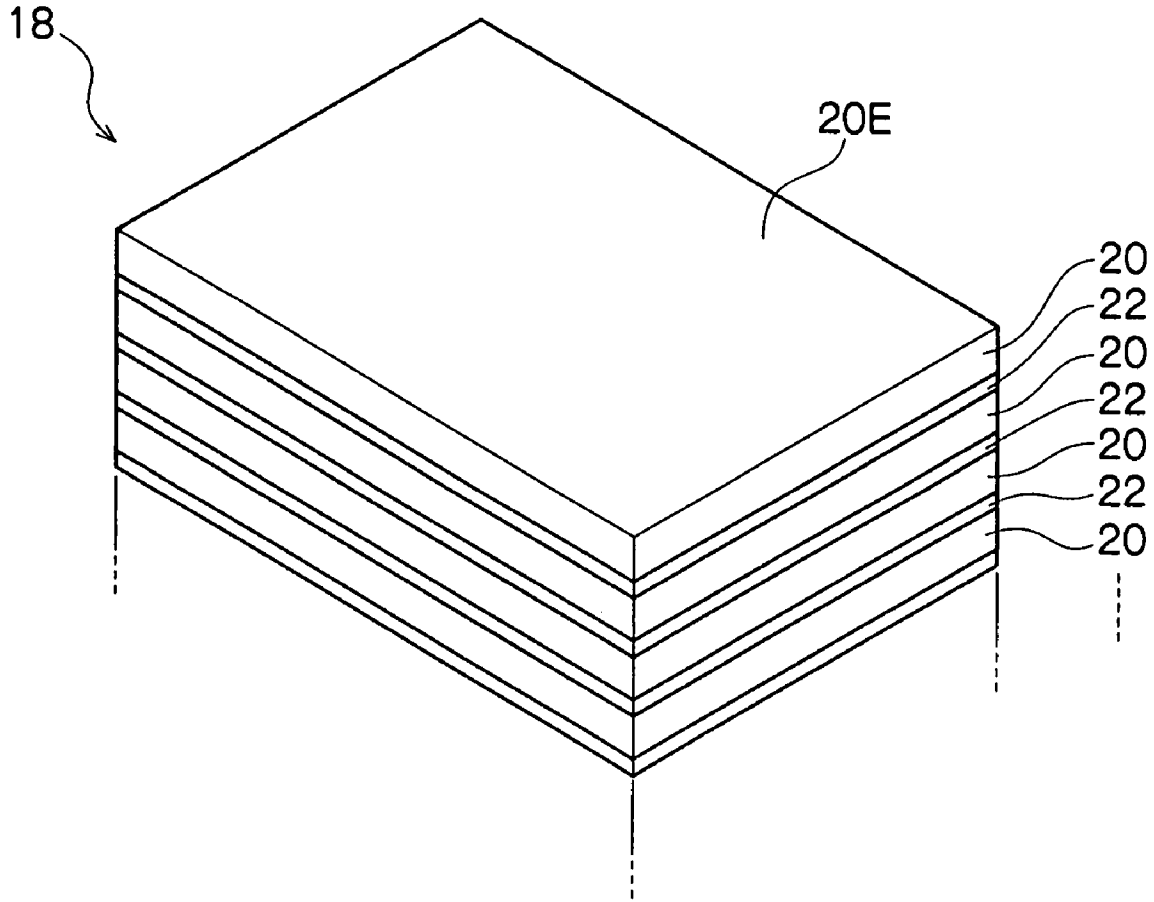
FIG. 3 is a perspective view showing a plate bundle to be set in the planographic printing plate supply unit of FIG. 1.

As shown in FIG. 3, in a planographic printing plate 20, sensitizing agent face 20E is formed by coating a face of a supporting body formed in the form of sheet with aluminum or the like with a sensitizing agent. A covering paper 22 for protecting the sensitizing agent face 20E and the planographic printing plate 20 are stacked alternately so as to compose a bundle 18. FIG. 3 represents a condition in which they are stacked with the sensitizing agent face 20E facing upward with the covering paper 22 which protects the sensitizing agent face 20E of the uppermost planographic printing plate 20 already removed.

As shown in FIG. 1, the planographic printing plate supply unit 12 is equipped with a base 26 and the loading portion 14 and the carrying portion 16 are disposed on the top of the base 26. The base 26 is provided with casters 28 so that the entire planographic printing plate supply unit 12 can be moved so that, for example, it can be attached to/detached from a planographic printing plate insertion portion or the like of an exposure unit.

As shown in FIG. 2, the loading portion 14 has a flat, square loading tray 30 and two side end guide plates 32 and a rear end guide plate 34 are disposed within the loading tray 30. The side end guide plates 32 slide in a direction of an arrow W by means of a sliding mechanism (not shown) so as to arrange side faces of a plate bundle 18, that is, the plural planographic printing plates 20 and covering papers 22 neatly corresponding to the size of the planographic printing plate 20. Likewise, the rear end guide plate 34 slides in a direction of an arrow F (and in an opposite direction) by means of a sliding mechanism (not shown) so as to arrange the rear end of the plate bundle 18 neatly.

The loading portion 14 is provided with plural covers 36 for covering the surroundings of the loaded plate bundle 18. When attached to the exposure unit, a cover 36A for covering the end portion in the downstream in the transportation direction of the plate bundle 18 is pressed upward by a pressing member (not shown) and rotated around a hinge 38 so that it is swung upward as shown in FIG. 1.

As shown in FIG. 2, a holder 40 is stretched over the loading portion 14 along the width direction of the planographic printing plate 20. A pick-up roller 42 is mounted rotatably on the holder 40 such that it is located over the plate bundle 18 loaded on the loading portion 14 and a drive force of a drive motor 44 acts via an endless belt 46, and it is rotated in the direction of carrying the planographic printing plate 20 (or covering paper 22) (hereinafter, the rotation in this direction is referred to as "forward rotation", indicated by an arrow J). Meanwhile, the direction of carrying the planographic printing plate 20 is indicated by an arrow F (hereinafter referred to as "carrying direction F") and a direction perpendicular thereto (width direction of the planographic printing plate 20) is indicated by an arrow W (hereinafter it is referred to as "width direction W").

The holder 40 is rotatable around a supporting shaft 48 provided at both ends in the width direction and downstream in the transportation direction. The pick-up roller 42 is rotated by a rotation driving force from a drive unit 50 provided sideway of the holder 40 between a carrying position in which the pick-up roller 42 applies a predetermined pressure and contacts with the plate bundle 18 and a removed position in which it is removed from the plate bundle 18.

The bottom portion of the loading tray 30 is a loading plate 52 which swings by a hinge (not shown) provided upstream in the carrying direction. With the plate bundle 18 loaded on the loading plate 52, the loading plate 52 is urged upward by an urging member (not shown) so that the uppermost planographic printing plate 20 makes firm contact with the pick-up roller 42. A pressing force from the pick-up roller 42 to the plate bundle 18 is controlled to an extent that allows a pair of the planographic printing plate 20 and the covering paper 22 to be carried together.

Figure 4:
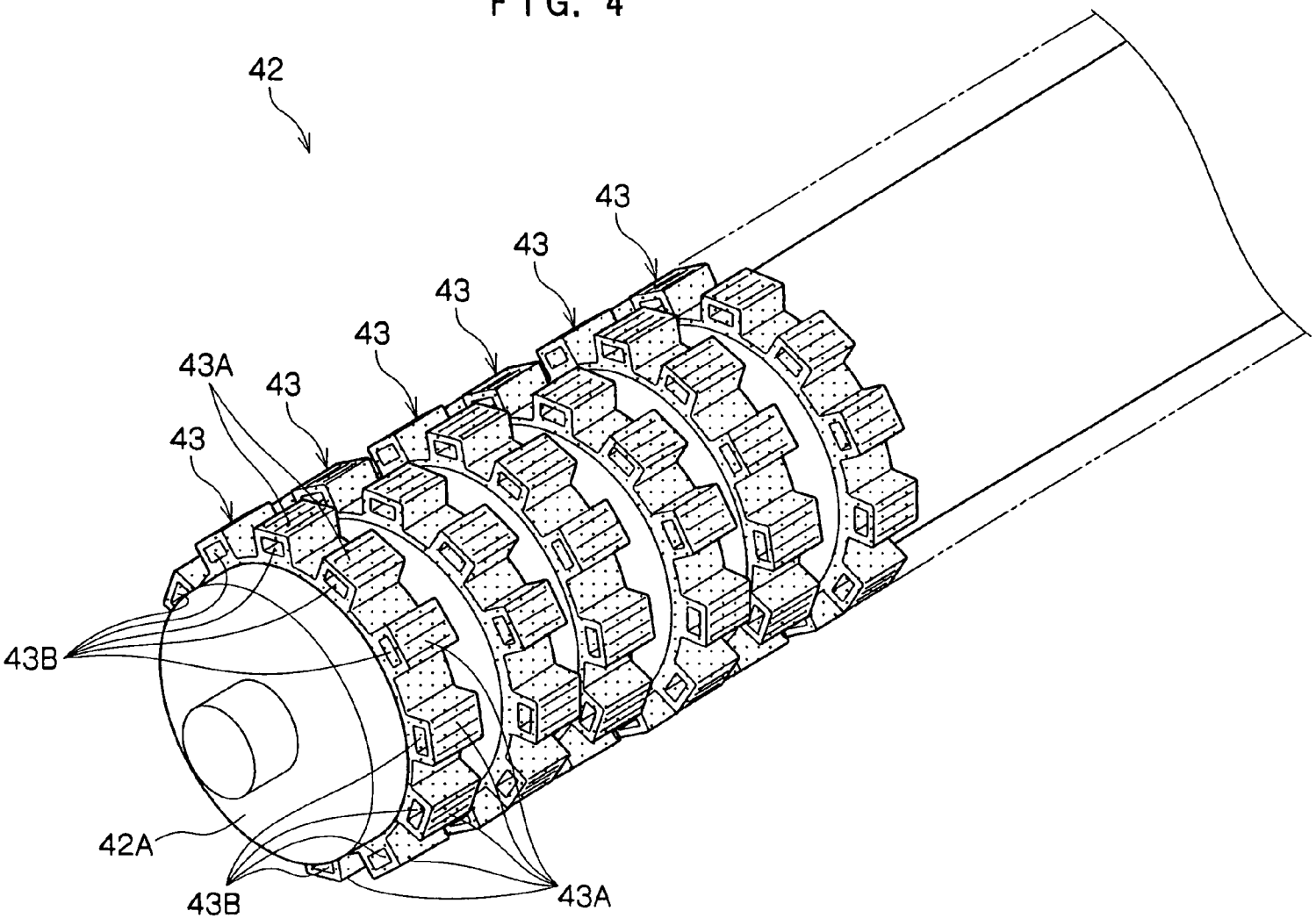
FIG. 4 is a perspective view of part of a pick-up roller according to a first embodiment of the invention.

As shown in FIG. 4, the pick-up roller 42 is so constructed that block wheels 43 are mounted around the outer peripheral portion of a cylindrical shaft portion 42A. The block wheel 43 has a ring shape and plural blocks 43A disposed at an equal interval along the circumference of the pick-up roller 42. The block wheels 43 are arranged at an equal interval from an end to the other in the axial direction of the pick-up roller 42. Each block 43A is made of substantially rectangular parallelepiped rubber, which is elastically deformable. A hollow portion 43B passes through the block 43A in the axial direction of the pick-up roller 42. Although the hollow portions 43B are not absolutely necessary, the hollow structure allows the block 43A to be elastically deformed easily even under a small pressing force even if it is made of material difficult to elastically deform due to high hardness and excellent durability.

Figure 5A:
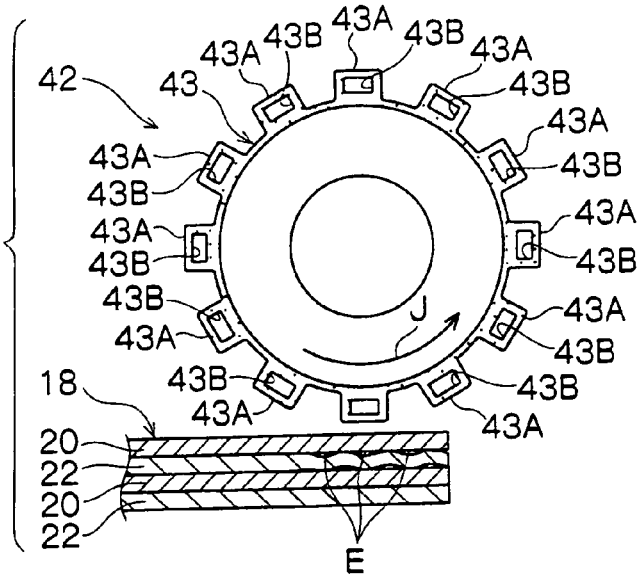
FIG. 5A is a side view showing the relation between the pick-up roller and the planographic printing plate/covering paper according to the first embodiment of the invention and a condition in which the pick-up roller and the planographic printing plate are not in contact with each other.
Figure 5B:
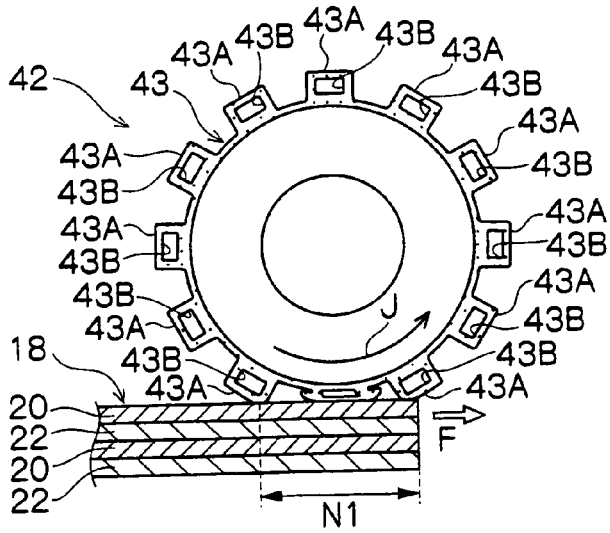
FIG. 5B is a side view showing a condition in which the pick-up roller and the planographic printing plate shown in FIG. 5A are in contact with each other.

As shown in FIG. 5A, the pick-up roller 42 is disposed at the front end of the plate bundle 18. As shown in FIG. 5B, the block 43A contacting with the planographic printing plate 20 located at the top of the stacking bundle, is elastically deformed by a pressing force from the pick-up roller 42 and crushed, so that it contacts with the front end corner of the planographic printing plate at the top of the stacking bundle at a contact area N1 including the front end corner of the planographic printing plate 20.

As shown in FIG. 1, two guide plates 54, 56 are disposed at a predetermined interval in the carrying direction F downstream in the carrying direction relative to the loading portion 14. The planographic printing plate 20 is carried while supported by these guide plates 54, 56.

A covering paper separating unit 58 is disposed between the guide plates 54 and 56. The covering paper separating unit 58 has a carrying roller unit 60 and a retard roller unit 62 disposed along the carrying direction F. As shown in FIG. 2, each of these is constituted of a rotatable shaft 64 stretched along the width direction W and a plurality of rubber rollers 66 fixed on the shaft 64 at a predetermined interval. If the shaft 64 is rotated by receiving a drive force from a drive motor 61, the rubber rollers 66 of the carrying roller unit 60 are rotated (forward) in the direction of an arrow R1 and the rubber rollers 66 of the retard roller unit 62 are rotated (inversely) in the direction of an arrow R2 which is an opposite direction to the arrow R1.

The retard roller unit 62 is moved from a position in which it contacts with the covering paper being carried and a position in which it is removed from the covering paper 22 by the drive unit 68 provided at an end thereof. Because the retard roller unit 62 is rotated inversely while making contact with the covering paper 22, the covering paper 22 can be separated from the planographic printing plate 20.

The rubber rollers 66 of the retard roller unit 62 contacts with the rubber rollers 66 of the carrying roller unit 60 to nip the covering paper 22 between the rubber rollers 66 of the carrying roller unit 60 and the rubber rollers 66 of the retard roller unit 62.

The nip roller 70 is stretched rotatably over the carrying roller unit 60 in the width direction. The nip roller 70 contacts with the planographic printing plate 20 and the covering paper 22 such that it is capable of nipping them between the nip roller 70 and rubber rollers 66 of the carrying roller unit 60 due to its own weight.

Covering paper carrying roller units 72A, 72B are disposed below the carrying roller unit 60 and the retard roller unit 62. The covering paper carrying roller units 72A, 72B are constituted of a shaft 64 and rubber rollers 66 like the carrying roller unit 60 and the retard roller unit 62, so that the covering paper 22 can be nipped between the rubber rollers 66 of the covering paper carrying roller units 72A and 72B. If the covering paper carrying roller units 72A, 72B rotate with the covering paper 22 nipped between the rubber rollers 66, the nipped covering paper 22 can be carried downward along a carrying belt 74.

An collection box 76 in which the covering papers 22 are to be collected, is provided below the covering paper carrying roller units 72A, 72B.

Next, the operation of this embodiment will be described.

When the planographic printing plates 20 are supplied to an exposure unit from the planographic printing plate supply unit 12 having the above-described structure, first, the plate bundle 18 is loaded on the loading portion 14. At this time, the plate bundle 18 is arranged neatly with the rear end 18B of the plate bundle 18 in contact with the rear end guide plate 34 and the side end 18S in contact with the side end guide plate 32.

Figure 5C:
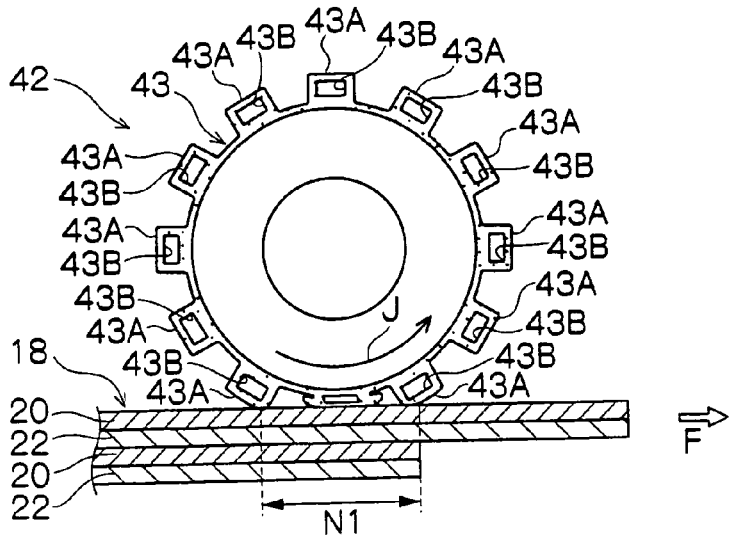
FIG. 5C is a side view showing a condition in which the uppermost planographic printing plate and covering paper are being fed out together by the pick-up roller shown in FIG. 5A.

When the planographic printing plate supply unit 12 is mounted at a predetermined position of the exposure unit, as shown in FIG. 1, the cover 36A rotates upward so that part (portion in the vicinity of the front end) of the plate bundle 18 is exposed. Before the pick-up roller 42 contacts with the plate bundle 18, as shown in FIG. 5A, wrinkles are generated in the covering paper 22 under the planographic printing plate 20 due to a difference in water content between air and the covering paper 22, so that air E is contained between the planographic printing plate 20 and the covering paper 22. When the holder 40 is driven by the drive unit 50 and the pick-up roller 42 contacts with the plate bundle 18, as shown in FIG. 5B, the block 43A is elastically deformed and crushed due to a pressing force from the pick-up roller 42 to the plate bundle 18, so that it contacts with the planographic printing plate 20 at a larger contact area N1 than before being elastically deformed. Because the uppermost planographic printing plate 20 is pressed downward at the contact area N1, air E existing between the planographic printing plate 20 and the covering paper 22 is released. Further, because the contact area between the pick-up roller 42 and the planographic printing plate 20 is large, the pressing force of the planographic printing plate 20 is dispersed so as to reduce distortion of the planographic printing plate 20 and prevent air from flowing in. Further, because the pick-up roller 42 keeps contact over the contact area N1 including the front end corner of the planographic printing plate 20, flow-in of air from the front end corner can be prevented. In this state, when the pick-up roller 42 is rotated in the direction of an arrow J, as shown in FIG. 5C, a pair of the planographic printing plate 20 and the covering paper 22 are carried together in the direction of an arrow F.

In the pick-up roller 42 having the above-described structure, it is possible to prevent only the planographic printing plate or two pairs of the planographic printing plate and the covering paper from being carried because of air existing between the planographic printing plate 20 and the covering paper 22.

Separation of the planographic printing plate 20 and the covering paper 22 is carried out in the covering paper separating unit 58. When commencement of transportation of the planographic printing plate 20 and the covering paper 22 is detected by a sensor, the carrying roller unit 60 and the retard roller unit 62 rotate so that the retard roller unit 62 lifts up. Then, if the rubber rollers 66 of the retard roller unit 62 are rotated inversely, coming into contact with the covering paper 22, a force in the carrying direction from the carrying roller unit 60 and a force in an opposite direction to the carrying direction from the retard roller unit 62 act on the covering paper 22, so that the covering paper 22 is separated from the planographic printing plate 20. The covering paper 22 is carried downward while nipped by the rubber rollers 66 of the carrying roller unit 60 and the retard roller unit 62 with its intermediate portion bent and collected in the collection box 76. The planographic printing plate 20 is carried further in the carrying direction F and sent to the exposure unit.

SECOND EMBODIMENT

Next, the second embodiment of the present invention will be described. Because the planographic printing plate supply unit of this embodiment is the same as the first embodiment except in the structure of the pick-up roller, only the structure of the pick-up roller will be described.

Figure 6:
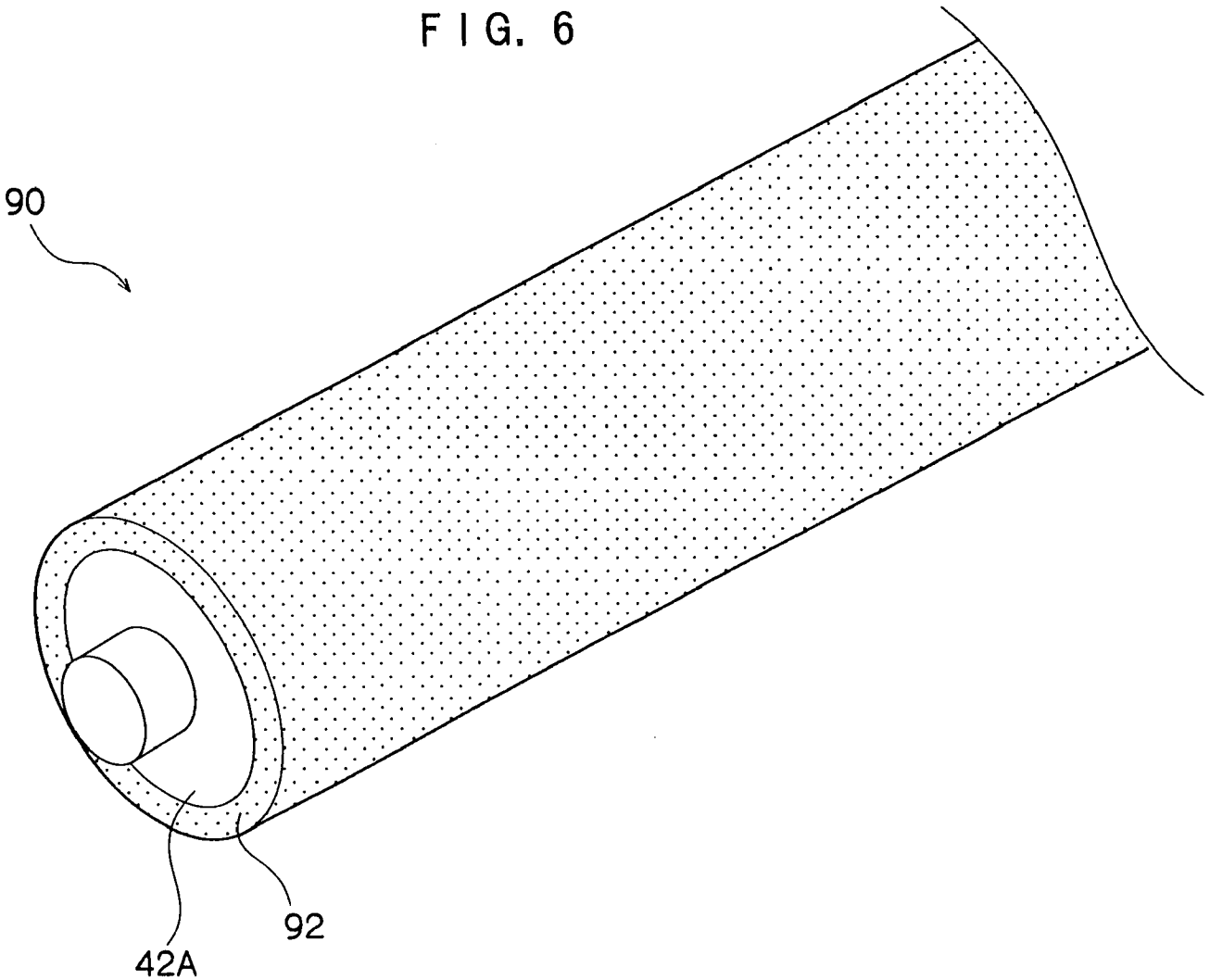
FIG. 6 is a perspective view of part of the pick-up roller according to a second embodiment of the invention.
Figure 7A:
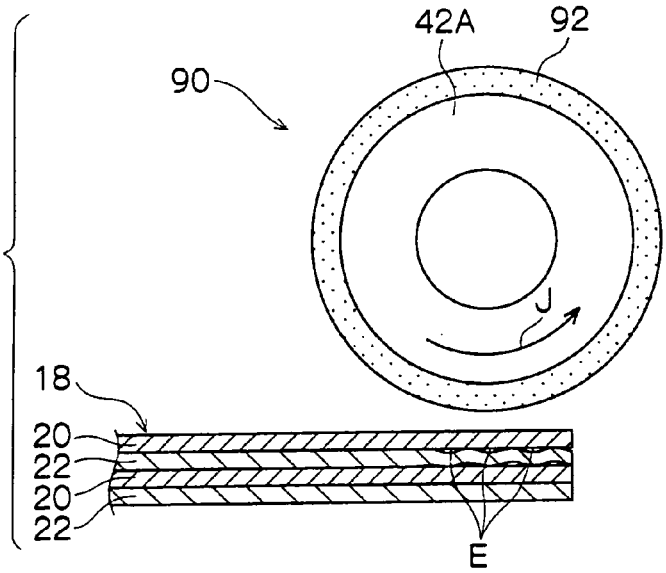
FIG. 7A is a side view showing the relation between the pickup roller and the planographic printing plate/covering paper according to the second embodiment of the invention and a condition in which the pick-up roller and the planographic printing plate are not in contact with each other.
Figure 7B:
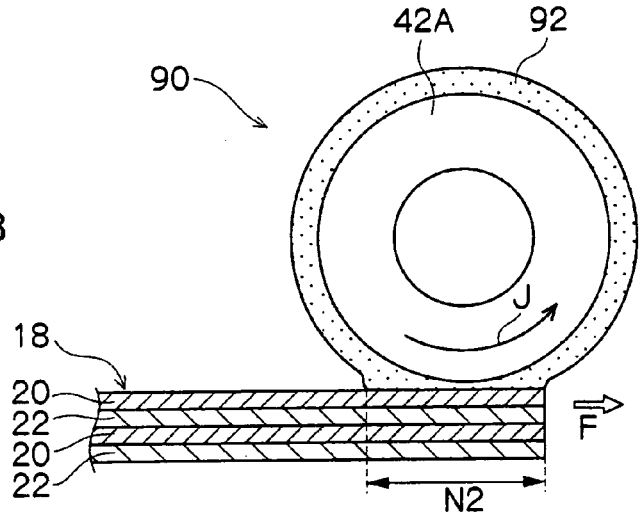
FIG. 7B is a side view showing a condition in which the pick-up roller and the planographic printing plate shown in FIG. 7A are in contact with each other.
Figure 7C:
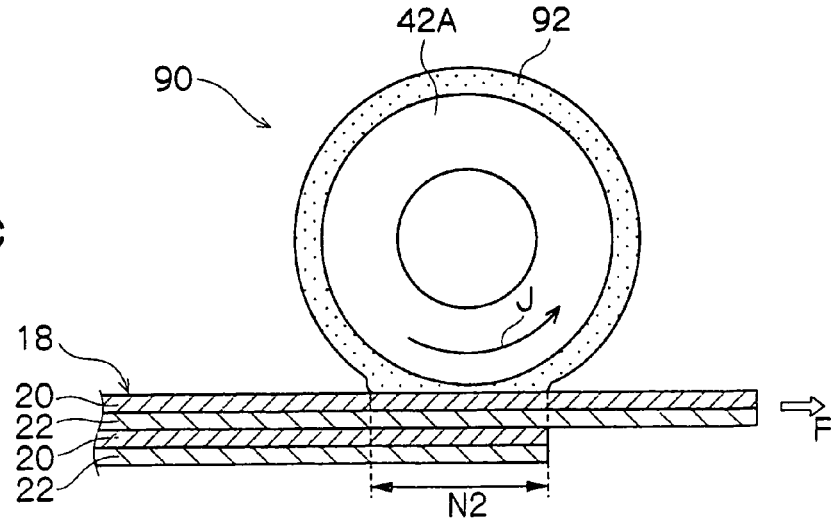
FIG. 7C is a side view showing a condition in which the uppermost planographic printing plate and covering paper are being fed out together by the pick-up roller shown in FIG. 7A.

As shown in FIG. 6, the pick-up roller 90 of the embodiment is provided with a soft rubber layer 92 having a specified thickness around the outside periphery of a cylindrical shaft portion 42A. The soft rubber layer 92 is composed of rubber having a hardness of 30 degrees. As shown in FIG. 7A, the pick-up roller 90 is disposed at the front end portion of the plate bundle 18. Then, as shown in FIG. 7B, the soft rubber layer 92 making contact with the uppermost planographic printing plate 20 is elastically deformed and crushed due to a pressing force from the pick-up roller 90, so that it comes into contact with the front end corner of the planographic printing plate 20. As shown in FIGS. 7B and 7C, the soft rubber layer 92 making contact with the planographic printing plate 20 is elastically deformed and crushed due to the pressing force from the pick-up roller 90 to the planographic printing plate 20, so that it keeps contact with a contact area N2 including the front end corner of the planographic printing plate 20.

Although the soft rubber layer 92 of this embodiment is composed of rubber having a hardness of 30 degrees, the hardness does not always need to be 30 degrees, but only needs to be from 20 degrees to 40 degrees.

Next, the operation of this embodiment will be described.

Before the pick-up roller 90 contacts with the plate bundle 18, as shown in FIG. 7A, wrinkles are generated in the covering paper 22 under the planographic printing plate 20, so that air E may be contained between the planographic printing plate 20 and the covering paper 22. When the holder 40 is driven and the pick-up roller 90 comes into contact with the plate bundle 18 as in the first embodiment, as shown in FIG. 7B, the bottom portion of the soft rubber layer 92 is elastically deformed and crushed due to the pressing force from the pick-up roller 90 to the plate bundle 18, so that it contacts with the planographic printing plate 20 over a contact area N2 larger than before being elastically deformed. In the contact area N2, the uppermost planographic printing plate 20 is pressed downward so that air E existing between the planographic printing plate 20 and the covering paper 22 is released. Further, because the contact area between the pick-up roller 90 and the planographic printing plate 20 is large, the pressing force to the planographic printing plate 20 is dispersed so as to reduce distortion of the planographic printing plate 20 and prevent air from flowing into gaps. Because the pick-up roller 90 contacts over the contact area N2 including the front end corner, air is prevented from flowing in from the front end corner. When the pick-up roller 90 is rotated in the direction of the arrow J in this state, as shown in FIG. 7C, a pair of the planographic printing plate 20 and the covering paper 22 are carried together in the direction of the arrow F.

In the pick-up roller 90 having the above-described structure, it is possible to prevent only the planographic printing plate or two pairs of the planographic printing plate and the covering paper from being carried because of air existing between the planographic printing plate 20 and the covering paper 22 like the first embodiment.

THIRD EMBODIMENT

Next, the third embodiment of the present invention will be described. Because the planographic printing plate supply unit of this embodiment is the same as the first embodiment except in the structure of the pick-up roller, only the structure of the pick-up roller will be described.

Figure 8:
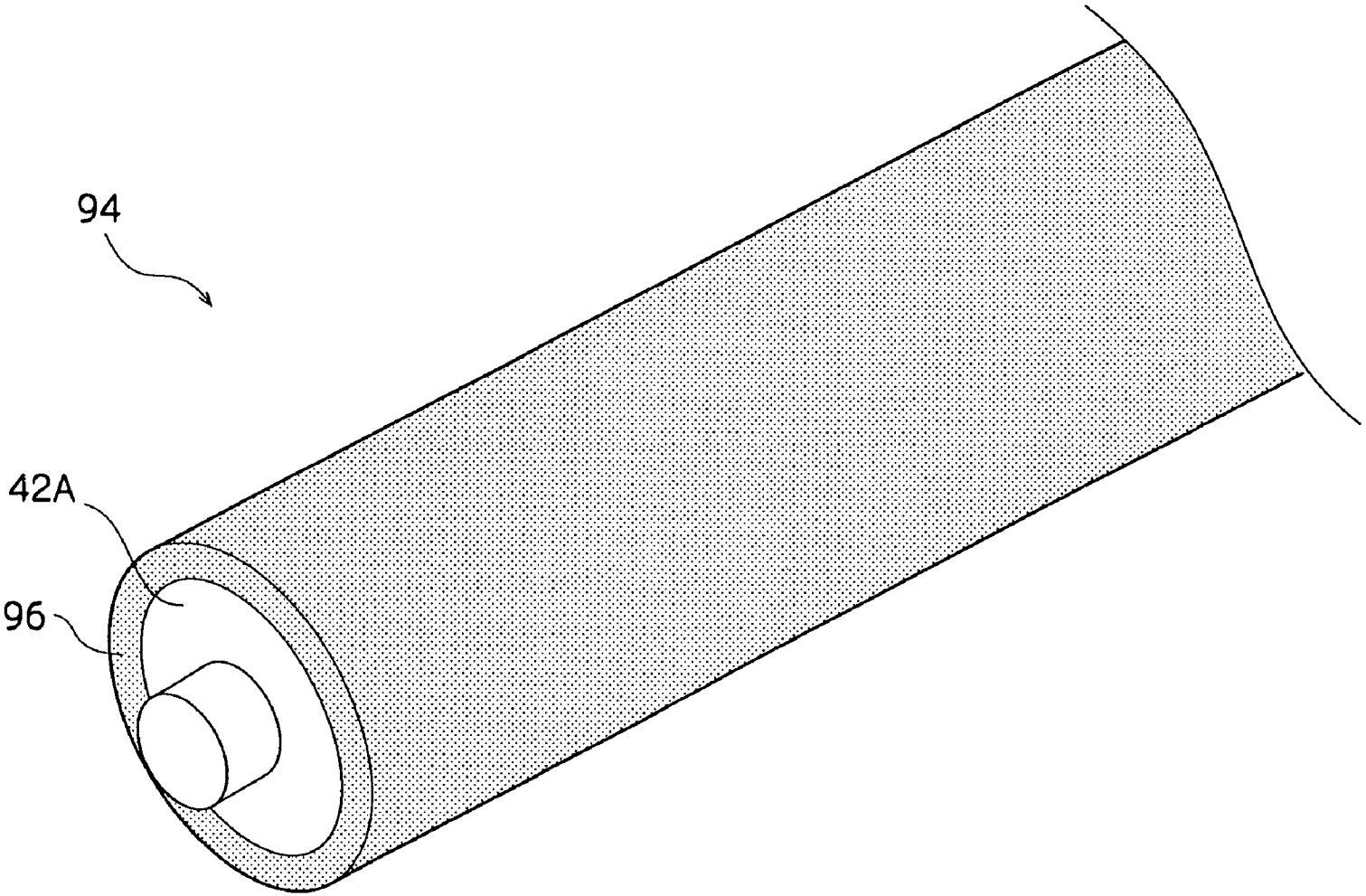
FIG. 8 is a perspective view of part of the pick-up roller according to a third embodiment of the invention.
Figure 9A:
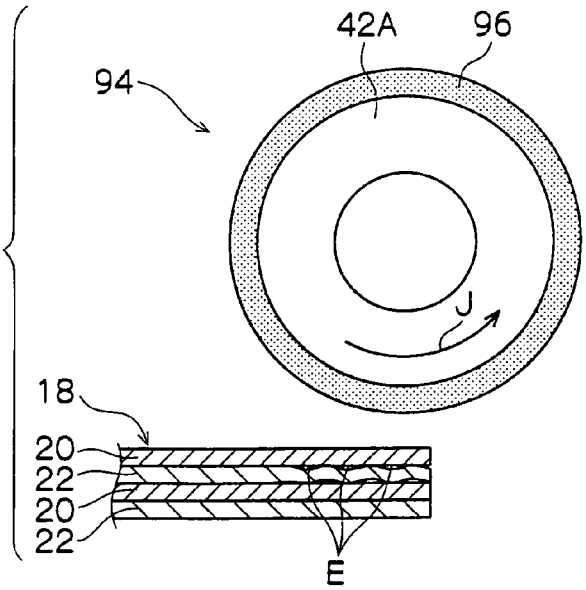
FIG. 9A is a side view showing the relation between the pick-up roller and the planographic printing plate/covering paper according to the third embodiment of the invention and a condition in which the pick-up roller and the planographic printing plate are not in contact with each other.

As shown in FIG. 8, the pick-up roller of the embodiment is provided with an adhesive rubber layer 96 having a specified thickness around the outside periphery of a cylindrical shaft portion 42A. The adhesive rubber layer 96 is composed of rubber having adhesive force. As the rubber having adhesive force, butyle rubber may be used. As shown in FIG. 9A, the pick-up roller 94 is disposed at the front end portion of the plate bundle 18. Then, as shown in FIG. 9B, the adhesive rubber layer 96 contacts with the uppermost planographic printing plate 20 at a contact area N3 including the front end corner of the planographic printing plate 20.

Next, the operation of this embodiment will be described.

Figure 9B:
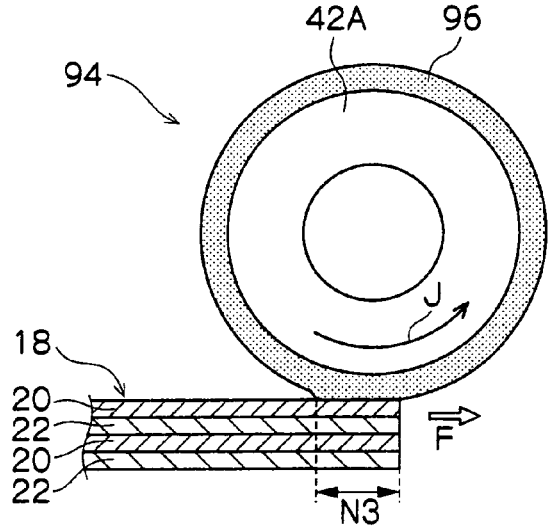
FIG. 9B is a side view showing a condition in which the pick-up roller and the planographic printing plate shown in FIG. 9A are in contact with each other.
Figure 9C:
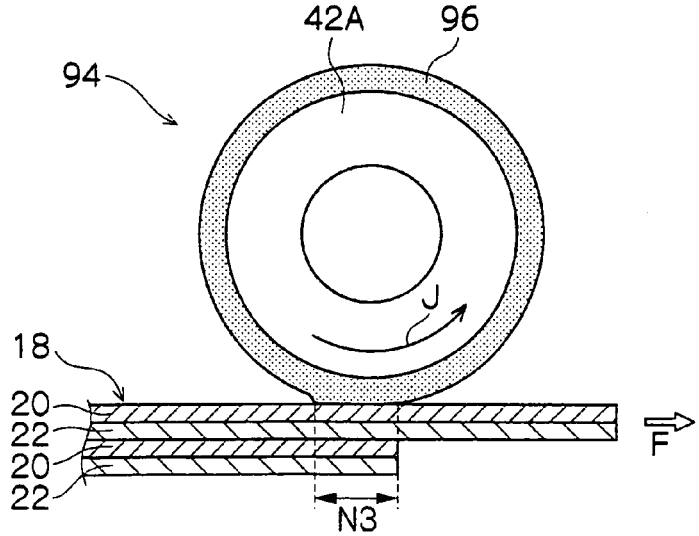
FIG. 9C is a side view showing a condition in which the uppermost planographic printing plate and covering paper are being fed out together by the pick-up roller shown in FIG. 9A.

When the holder 40 is driven and the pick-up roller 90 comes into contact with the plate bundle 18 as in the first embodiment, as shown in FIG. 9B, the bottom portion of the adhesive rubber layer 96 contacts with the planographic printing plate 20 at a contact area N3. In the contact area N3, the adhesive rubber layer 96 adheres to the planographic printing plate 20 detachably. Due to this adhesion, the uppermost planographic printing plate 20 and covering paper 22 can be carried with a small pressing force. When the pressing force can be set so as to be small, distortion of the planographic printing plate 20 can be reduced, so that air can be prevented from flowing into the gaps between the planographic printing plates 20. Further, because the pick-up roller 94 contacts with the contact area N3 including the front end corner of the planographic printing plate 20, flow-in of air from the front end corner can be prevented. When the pick-up roller 94 is rotated in the direction of the arrow J under this condition, as shown in FIG. 9C, the uppermost planographic printing plate 20 and covering paper 22 are carried together in the transportation direction F.

With the pick-up roller 94 having the above-described structure, it is possible to prevent only the planographic printing plate or two pairs of the planographic printing plate and the covering paper from being carried because of air existing between the planographic printing plate 20 and the covering paper 22 like the first embodiment and the second embodiment.

Because the planographic printing plate supply unit of the embodiment of the present invention has the above-described structure, such a simple structure makes it possible to reliably remove a planographic printing plate and covering paper pair by pair from a stacking bundle of the planographic printing plates and covering papers.

What is claimed is:

1. A planographic printing plate supply unit comprising:

a carrying roller rotating while pressing a stacking bundle in which planographic printing plates and covering papers are stacked alternately so as to carry an uppermost planographic printing plate and covering paper at the top of the stacking bundle, the carrying roller having plural block wheels mounted thereon, each block wheel comprising an elastic material disposed in a ring shape and including convex portions disposed at equal intervals along the outside periphery of the block wheel, each of the convex portions having a substantially rectangular parallelepiped shape and a hollow portion, the convex portions being elastically deformed when pressing the stacking bundle and having a contact area with the uppermost planographic printing plate that is larger after being elastically deformed than before being elastically deformed.

2. The planographic printing plate supply unit of claim 1 wherein the convex portions are provided along at least one of the axial direction and the circumferential direction of the carrying roller at a predetermined interval.

3. The planographic printing plate supply unit of claim 1 wherein the carrying roller is disposed at a position in which an elastically deformed portion thereof formed when the carrying roller presses the uppermost planographic printing plate contacts with a corner of the uppermost planographic printing plate.

* * * * *